US005456316A

United States Patent [19]

Owens et al.

[11] Patent Number: 5,456,316

[45] Date of Patent: Oct. 10, 1995

[54] DOWNHOLE SIGNAL CONVEYING SYSTEM

[75] Inventors: Steven C. Owens, Katy; Paul A. Reinhardt; Richard Ross, both of Houston, all of Tex.

[73] Assignee: Baker Hughes Incorporated, Houston, Tex.

[21] Appl. No.: 233,368

[22] Filed: Apr. 25, 1994

[51] Int. Cl.[6] ..... E21B 47/00

[52] U.S. Cl. ..... 166/250.01; 166/65.1; 73/151; 340/853.3

[58] Field of Search ..... 166/250, 64, 65.1; 175/40; 73/510, 151, 158, 652; 340/853.1, 853.3, 853.9

[56] References Cited

U.S. PATENT DOCUMENTS

| | | | |
|---|---|---|---|
| 3,964,553 | 6/1976 | Basham et al. | 175/4.51 |
| 4,293,936 | 10/1981 | Cox et al. | 166/73 X |
| 4,508,174 | 4/1985 | Skinner et al. | 166/250 X |
| 4,583,592 | 4/1986 | Gazda et al. | 166/250 |
| 4,640,354 | 2/1987 | Boisson | 166/250 |
| 4,678,035 | 7/1987 | Goldschild | 166/386 X |
| 4,839,644 | 6/1989 | Safinya et al. | 166/250 X |
| 4,896,722 | 1/1990 | Upchurch | 166/250 |
| 5,144,591 | 9/1992 | Hardage | 175/40 X |
| 5,293,937 | 3/1994 | Schultz et al. | 166/250 |
| 5,361,838 | 11/1994 | Kilgore | 166/64 X |

OTHER PUBLICATIONS

SPE No. 27601—"Monobore Completions for Slimhole Wells", by C. E. Robinson, Halliburton Energy Services, 1994.

Slick Line Tools, Inc. Catalog, "Slick Line Firing Device and Freepoint Indicator to Run On Solid Non-Conductor Line", date unknown, (8 p).

Petroleum Engineering Services Limited, "Time Delay Initiator", date unknown, (1 p).

*Primary Examiner*—Roger J. Schoeppel

*Attorney, Agent, or Firm*—Rosenblatt & Redano

[57] ABSTRACT

Actuation of downhole tools is accomplished by inducing motion in the wireline. The downhole tool monitors such motion for predetermined patterns. Detection of a predetermined pattern actuates performance of a desired function. The pattern selected is sufficiently unique to avoid random or premature actuation. The tool may thus be actuated using ordinary nonconducting cable. In like fashion the tool can transmit stored information to the surface by a mechanical means such the resonant frequency of a mechanical signal in the cable.

13 Claims, 2 Drawing Sheets

DOWNHOLE SIGNAL CONVEYING SYSTEM

FIELD OF THE INVENTION

The present invention relates to actuation of downhole tools and sending information to the surface, particularly by use of nonconducting wireline.

BACKGROUND OF THE INVENTION

In the operation of oil well tools, it is necessary to actuate the tool at a desired location downhole. Various systems for actuating the tools have been used. One system uses an electric line cable to transmit control signals which actuate the downhole tool to receive data from the tool. Electric line well intervention can be costly, requires special tools and trained personnel, and can cause rig delays. Offshore, space for electric line equipment could be a problem since equipment for other procedures scheduled before or after running the tool may already occupy what little space is available.

Another system uses established profiles in the well to set and actuate the tools. However such systems are only useful when profiles are present in the completed well. In such systems the tool becomes supported by the recessed profile with the resulting weight shift actuating the tool. These systems are subject to inexact actuation when the tool encounters restrictive passages downhole and exhibits the same conditions as being suspended in the profiles.

A third system uses a pressure sensor to actuate the tool when the pressure downhole exceeds a predetermined level. Such systems are subject to inexact actuation due to deviations in downhole temperature and pressure conditions and sensitivities of known pressure transducers.

A fourth system uses an accelerometer with a time delay, actuating the tool when no motion has been detected for a predetermined period. Such systems are obviously subject to premature actuation if the tool becomes lodged downhole.

It is the object of the present invention to actuate downhole tools and to transmit collected data uphole using only a nonconducting cable. The present invention allows control over and communication with downhole tools using readily available rig equipment and personnel.

SUMMARY OF THE INVENTION

Actuation of downhole tools is accomplished by inducing motion in the wireline. The downhole tool monitors such motion for predetermined patterns. Detection of a predetermined pattern actuates performance of a desired function. The pattern selected is sufficiently unique to avoid random or premature actuation. The tool may thus be actuated using ordinary nonconducting cable. In like fashion the tool can transmit stored information to the surface by a mechanical means such the resonant frequency of a mechanical signal in the cable.

DETAILED DESCRIPTION OF THE PREFERRED EMBODIMENT

Figure 1:
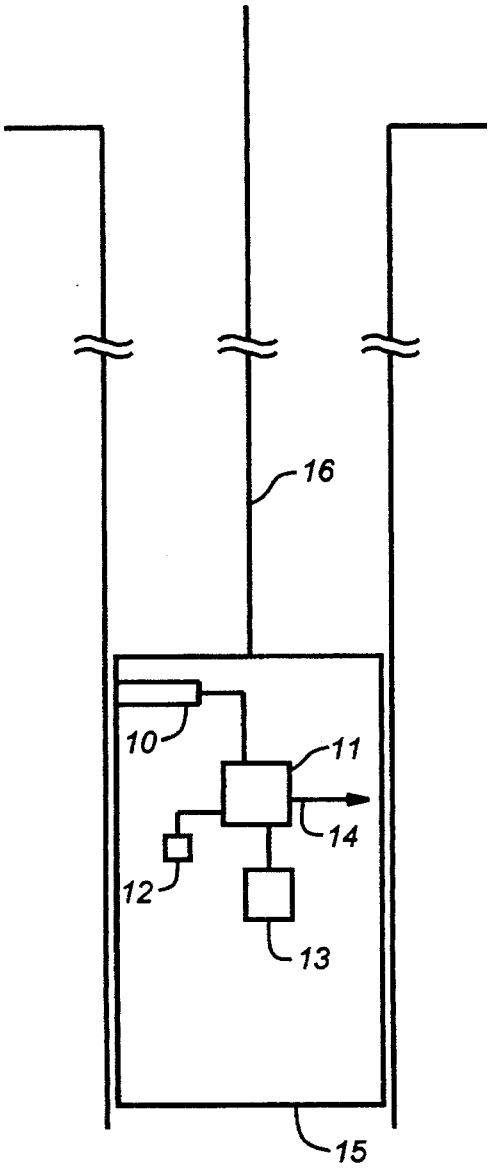
FIG. 1 is a block diagram of the components necessary for an operable actuator system according to the present invention.
Figure 2:
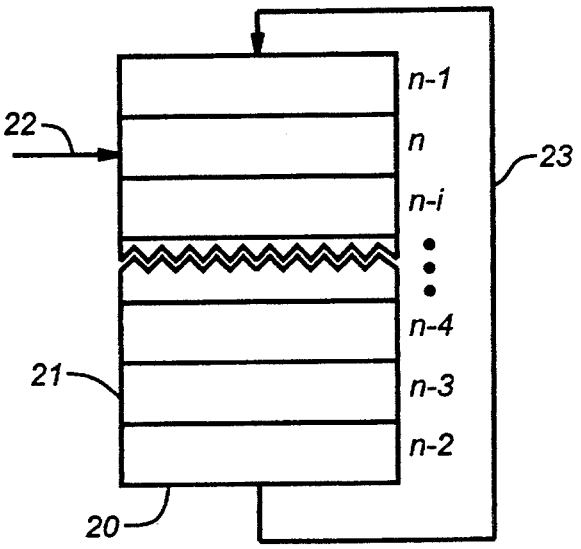
FIG. 2 is a representation of a circular buffer, the preferred configuration of the memory device used in the actuator system.
Figure 3:
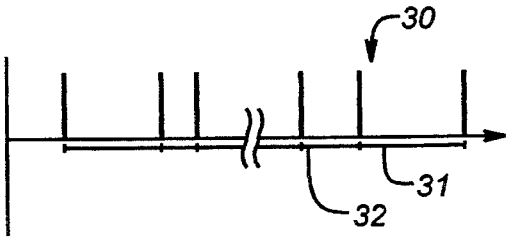
FIG. 3 is a timing diagram representing generally unit inputs of motion and corresponding intervals which may constitute a predetermined pattern.
Figure 4:
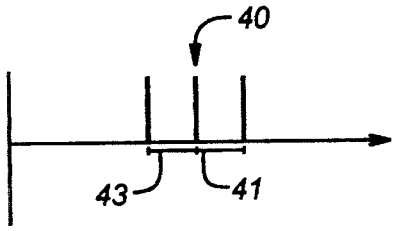
FIG. 4 is an exemplary timing diagram showing one possible predetermined pattern.
Figure 5:
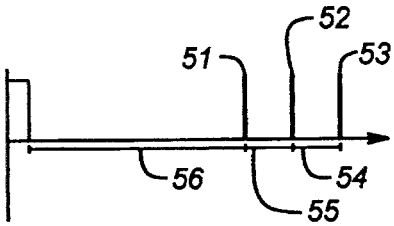
FIG. 5 is an exemplary timing diagram showing the timing of induced motion necessary to actuate the tool which is set to respond to the predetermined pattern of FIG. 4.
Figure 7:
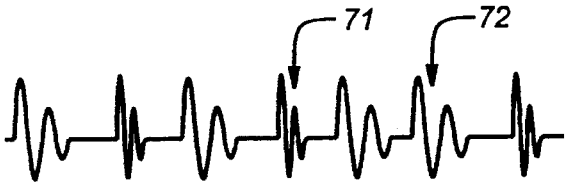
FIG. 7 portrays a time-based signal corresponding to induced motion of different frequencies in the wireline.
Figure 8:
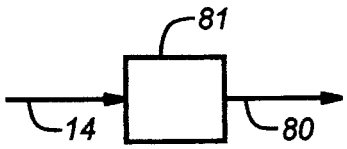
FIG. 8 is a block diagram representative of a secondary safety device interposed to prevent premature actuation.
Figure 6:
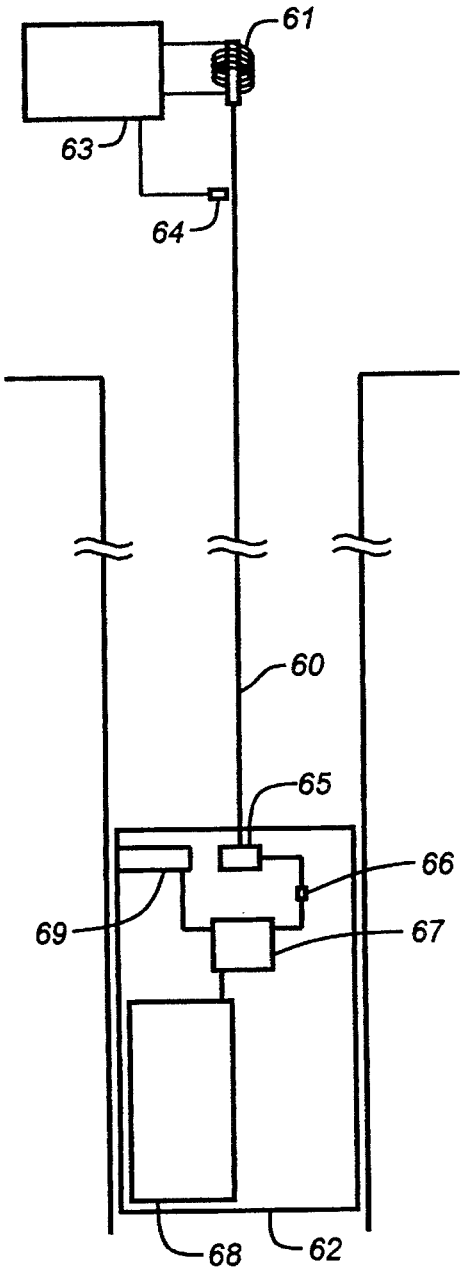
FIG. 6 is a block diagram of the components necessary to allow transmission of data from the downhole tool according to the present invention.

Motion induced in a nonconducting wireline is used to actuate a downhole tool. Motion may be induced either manually or by a solenoid 61 attached to the wireline. A predetermined pattern of motion will cause the tool to actuate.

A motion detector 10 in the downhole tool transmits a signal to a microprocessor 11 or other suitable control circuit when it detects motion. Upon receipt of a signal from the motion detector, the microprocessor reads the time value corresponding to that signal from a real-time clock 12 and stores that time value in a memory device 13.

In the simplest embodiment of the present invention, the memory device is configured as a circular buffer 20 consisting simply of an fixed array of addressable memory locations 21. A pointer 22 indicates the memory location to be addressed and advances to the next memory location in the array when the indicated memory location is addressed. When the pointer reaches the last memory location in the array it cycles 23 back to the first memory location in the array. Thus, once every memory location in the buffer has been previously addressed, the oldest time value is replaced by the time value corresponding to the most recently detected motion. The number of memory locations i in the circular buffer preferably corresponds to the number necessary to determine if the predetermined pattern of motion has occurred.

The microprocessor 11 uses the time values to determine if the predetermined pattern 30 of motion has occurred. Each time a signal is received from the motion detector and the corresponding time value is stored in a memory location n, the microprocessor compares the new time value to the time value stored in the preceding memory location n–1. If the interval between the two time values correlates to the last interval 31 of the predetermined pattern, the interval between the preceding time values n–1 and n–2 is determined and compared to the preceding interval 32 of the predetermined pattern. Each time the interval between time values matches the corresponding interval in the predetermined pattern, the preceding intervals are compared until either unmatching intervals are found or the predetermined pattern is detected. If unmatching intervals are found, the microprocessor simply awaits a new signal from the motion detector and repeats the process with a new time value. If the predetermined pattern is detected, the microprocessor transmits a signal 14 which actuates the tool.

By way of example, suppose the selected pattern consisted of two two-minute intervals. The tool is lowered downhole and remains motionless for ten minutes. To actuate the tool downhole, motion is induced in the wireline three times at proper two minute intervals. When the first motion 51 is detected, the corresponding time value is stored and the microprocessor compares the interval since the last detected motion 56 with the last interval of the predetermined pattern 41. Since the intervals do not match, the microprocessor simply awaits further input from the motion detector. When the second motion 52 is detected, the corresponding time value is stored and the microprocessor again compares the interval since the last detected motion 55 with the last interval of the predetermined pattern 41. Since the intervals match, the microprocessor also compares the preceding interval between detected motions 56 with the preceding interval in the predetermined pattern 43. These intervals do not match, and the microprocessor again awaits further input from the motion detector. When the third motion 53 is detected, the same comparisons are made and the microprocessor, determining that intervals 54 and 55 match intervals 41 and 43 respectively, transmits a signal 14 which actuates the tool.

A virtually infinite number of predetermined patterns may be used. As few as two elements of motion or nonmotion may be used to define the predetermined pattern, although the pattern must be sufficiently unique to virtually preclude unintentional actuation. Overly complex patterns should be avoided since they will merely annoy individuals actuating the tool.

Unit impulses of motion separated by intervals of nonmotion provide the simplest patterns for actuation. However timed intervals of motion may be used as part of the predetermined pattern as well as intervals of nonmotion. With an appropriate motion detector, motion direction may also form part of the predetermined pattern. In either of these cases, the modifications necessary for pattern detection will be obvious to one of ordinary skill in the art.

In another embodiment of the present invention, the microprocessor 11, real time clock 12, and memory device 13 are replaced by an application specific integrated circuit (ASIC) asychronously clocked by the motion detector. The ASIC compares intervals between signals from the motion detector with intervals in the predetermined pattern and sets or resets flags accordingly. When the requisite number of flags are set, the ASIC transmits a signal actuating the tool.

In still another embodiment of the present invention, the predetermined pattern may be frequency-based rather than time-based. Motion induced in the wireline will propagate as a decaying sinusoidal wave having a natural resonant frequency. A variable damping mechanism may be used to alter that natural resonant frequency between a high frequency and a low frequency. The frequency of these waves may be detected, with initial synchronization patterns used to set thresholds for distinguishing high and low frequencies. Patterns of high and low frequencies may be used to transmit control codes in binary form to the downhole tool.

Induced motion may also be used to allow the downhole tool to transmit data to the surface. Motion induced in the wireline will reflect off the tool, propagating in both directions as a decaying sinusoid with a frequency equalling that of the natural resonant frequency of the system. An electronically controlled variable damping mechanism 65 such as a dash pot may be placed on the tool. Thus the tool can control the natural resonant frequency of waves propagating in the wireline, varying it between a high frequency and a low frequency. The high and low frequencies correspond to bits of data to be transmitted. The tool includes devices 68 for collecting and storing data of the desired type. The data could be, for example, the number of tubing collars which the tool detects as it is lowered. This data may be gathered in the same manner presently used in electric line operations, but the data would be stored at the tool instead of contemporaneously transmitted to the surface.

Similar to the first embodiment described, a predetermined pattern of motion is used actuate the tool's asynchronous mechanical transmission of data to the surface. In transmitting the data, the tool adjusts the variable damping mechanism 65 through a microprocessor or ASIC 67 and the appropriate control circuitry 66. This alters the natural resonant frequency to either a first frequency 71 or a second frequency 72, depending on the first bit of data to be transmitted. Motion is induced in the wireline at the surface, exciting the system into resonance. The motion travels as a decaying sinusoid at the resonant frequency before reflecting off the tool. At the surface, the frequency of the reflected wave is measured by an accelerometer 64 and interpreted for its binary value using conventional electronics 6-3. Meanwhile the tool, upon detecting the motion, waits an appropriate length of time before adjusting the variable damping mechanism, altering the natural resonant frequency to correspond to the next bit of data to be transmitted. If the value of the second bit of data matches the value of the first bit, the variable damping mechanism need not be adjusted. Motion is again induced in the wireline and the frequency of the reflection measured and interpreted. The tool again adjusts the variable damping mechanism, altering the natural resonant frequency to correspond to the next bit of data. This asynchronous process continues until all data is received at the surface.

Receipt of data from the downhole tool is especially useful, for example, when accurate placement of the tool is necessary before actuation. Surface cable counters are inaccurate due to slippage and cable stretch under downhole temperature conditions. However maps of the well, including locations of tubing collars, are normally available. Therefore the tool can be configured to count tubing collars as it is lowered and transmit the number of collars counted to the surface. A specific collar may be located by lowering the tool until the collar count is either the correct number or ±1, then raising or lowering the tool incrementally until the collar count changes, indicating that the desired collar has just been passed. Since the distance between tubing collars is short enough to render any error caused by slip or temperature stretch neglegible, once a specific collar is located the tool may be accurately placed using the surface cable counter.

In order to permit accurate detection of transmitted data at the surface, a synchronization code may be used to set thresholds and ranges for frequencies corresponding to bits of data. The tool first sends a predetermined pattern of high and low frequencies which is detected at the surface and used to determine the thresholds and ranges defining later bits of information. The tool then sends the data, which may be directly interpreted.

With any embodiment of the present invention, a secondary safety device 81 may be used to prevent premature actuation. For example, a pressure transducer or a temperature-actuated relay may be electrically connected to the actuator system such that actuation cannot occur until certain downhole pressure or temperature conditions are detected. The actuating signal 14 from the microprocessor is only relayed 80 to the tool if those conditions are detected. Such safety devices will insure that actuation does not occur before the tool has reached a threshold depth, preventing premature actuation and allowing use of simple motion patterns for actuation.

The foregoing disclosure and description of the invention are illustrative and explanatory thereof, and various changes in the size, shape and materials, as well as in the details of the illustrated construction, may be made without departing from the spirit of the invention.

We claim:

1. A method for actuating a downhole tool using a cable, comprising the steps of:

positioning the tool at a desired location downhole using said cable;

transmitting a mechanical signal via said cable by inducing a predetermined pattern of motion in the cable at a first location and detecting, said motion at a second location either along said cable or on the tool;

converting said mechanical signal into an electrical signal; and using said electrical signal to actuate the tool.

2. The method of claim 1 further comprising the initial step of:

providing a safety device preventing actuation before predetermined downhole conditions are detected.

3. The method of claim I wherein the positioning step further comprises:

providing a nonconducting cable;

attaching said tool to said nonconducting cable; and lowering said tool downhole until the desired location is reached.

4. The method of claim 1 wherein the convening step further comprises:

generating an electrical signal responsive to said detected motion;

comparing said generated electrical signal to a predetermined electrical signal; and, generating a second electrical signal for use in actuating the tool upon finding that said electrical signal matches said predetermined signal.

5. A downhole tool supported by a cable which self actuates in response to a predetermined pattern of motion, comprising:

means for connecting the tool to said cable;

means for detecting mechanical motion in the cable and generating at least one electrical signal responsive to said motion;

means for comparing said electrical signal to a predetermined pattern, said comparing means comprising a microprocessor capable of detecting said electrical signals, a real time clock operatively connected to said microprocessor, and a memory device having a plurality of locations operatively connected to said microprocessor, said microprocessor reading said real time clock upon detecting said electrical signal and storing the time in one said location of said memory device; and means for actuating the tool when said predetermined pattern is detected by said comparing means.

6. The downhole tool of claim 5 wherein said locations of said memory device are configured as a circular buffer.

7. The downhole tool of claim 6 wherein the number of said locations of said memory device is the minimum number necessary to detect said predetermined pattern.

8. A downhole tool supported by a cable which self actuates in response to a predetermined pattern of motion, comprising:

means for connecting the tool to said cable;

means for detecting mechanical motion in the cable and generating at least one electrical signal responsive to said motion;

means for comparing said electrical signal to a predetermined pattern; and means for actuating the tool when said predetermined pattern is detected by said comparing means.

9. A method for actuating a downhole tool using a cable, comprising the steps of:

positioning the tool at a desired location downhole using said cable by providing a nonconducting cable, attaching said tool to said nonconducting cable, and lowering said tool downhole until the desired location is reached;

transmitting a mechanical signal via said cable by inducing a predetermined pattern of motion in the cable at a first location by moving or striking the cable three times at two minute intervals and detecting said motion at a second location either along said cable or on the tool;

converting said mechanical signal into an electrical signal by generating an electrical signal responsive to said detected motion, comparing said generated electrical signal to a predetermined electrical signal, and generating a second electrical signal for use in actuating the tool upon finding that said electrical signal matches said predetermined signal; and using said second electrical signal to actuate the tool.

10. A method for nonelectrical transmission of data from a downhole tool comprising the steps of:

lowering the tool on a cable;

collecting data with said tool and storing said data at said tool;

signaling the tool from the surface to begin transmitting data;

providing a mechanical input to the cable;

receiving a nonelectrical responsive signal to said mechanical input;

interpreting said signal into a form recognizable as at least part of the collected data.

11. The method of claim 10 wherein said steps of providing a mechanical input and receiving a nonelectrical responsive signal respectively comprise:

inducing a wave in said cable; and receiving a reflected wave.

12. The method of claim 11 further comprising the steps of:

altering the resonant frequency of the cable and tool combination to correspond to at least part of the collected data;

measuring the frequency of said reflected wave to ascertain the corresponding part of the collected data;

repeating the inducing, receiving, and interpreting steps until all of the collected data is interpreted.

13. The method of claim 12 wherein said step of collecting data comprises counting collars and further comprising the steps of:

storing the collar count at any time on the tool;

converting the collar count to a binary representation; and determining said collar count from said interpreted data.

* * * * *